US007431630B2

(12) United States Patent
Dubois et al.

(10) Patent No.: US 7,431,630 B2
(45) Date of Patent: Oct. 7, 2008

(54) MOVEABLE TOY WITH CORRESPONDING AUDIO AND VISUAL OUTPUTS

(75) Inventors: David M. Dubois, East Aurora, NY (US); James Meade, Hamburg, NY (US); Kenneth Parker, Williamsville, NY (US); Marjorie D. Yoder-Parr, Uniontown, OH (US)

(73) Assignee: Mattel, Inc., El Segundo, CA (US)

( * ) Notice: Subject to any disclaimer, the term of this patent is extended or adjusted under 35 U.S.C. 154(b) by 152 days.

(21) Appl. No.: 10/895,927

(22) Filed: Jul. 22, 2004

(65) Prior Publication Data

US 2004/0266314 A1 Dec. 30, 2004

Related U.S. Application Data

(63) Continuation of application No. 10/347,511, filed on Jan. 21, 2003, now Pat. No. 6,997,773, which is a continuation of application No. 10/143,803, filed on May 14, 2002, now abandoned.

(60) Provisional application No. 60/331,329, filed on May 16, 2001.

(51) Int. Cl.
*A63H 33/02* (2006.01)

(52) U.S. Cl. ..... 446/451; 446/175

(58) Field of Classification Search ..... 446/450–453, 446/411–413, 175

See application file for complete search history.

(56) References Cited

U.S. PATENT DOCUMENTS

| | | | |
|---|---|---|---|
| 78,361 | A | 5/1868 | Clay |
| 346,656 | A | 8/1886 | Hopkins |
| 942,610 | A | 12/1909 | Bartholomae |
| 1,707,826 | A | 4/1929 | Tsobanacos |
| 2,259,629 | A | 10/1941 | Fisher |
| 2,552,288 | A | 5/1951 | Lee |
| 2,624,127 | A | 1/1953 | Okahara |
| 2,820,327 | A | 1/1958 | Charvat |
| 2,940,755 | A | 6/1960 | Pouder |
| 3,346,968 | A | 10/1967 | Dellinger |
| 3,629,970 | A | 12/1971 | Baynes et al. |
| 3,763,734 | A | 10/1973 | Meyer et al. |
| 3,768,179 | A | 10/1973 | Woodford et al. |
| 3,902,256 | A | 9/1975 | Liu |
| 3,958,344 | A | 5/1976 | Lesiak |
| 3,982,764 | A | 9/1976 | Dieball |
| 4,184,286 | A | 1/1980 | Spengler et al. |

(Continued)

FOREIGN PATENT DOCUMENTS

| | | |
|---|---|---|
| FR | 1416530 | 9/1964 |

OTHER PUBLICATIONS

Fisher-Price "*Corn-Popper*" products from website. Downloaded Oct. 18, 2004, available at www.fisher-price.com, 1 page. Available prior to Jul. 22, 2003.

*Primary Examiner*—Gene Kim
*Assistant Examiner*—Urszula M Cegielnik
(74) *Attorney, Agent, or Firm*—Cooley Godward Kronish LLP

(57) ABSTRACT

A toy having a motion detector that detects motion of the toy and generates a signal indicative of the motion. There is a visual display that is capable of selectively producing a visual output and an audio system capable of producing an audible output corresponding to, and descriptive of, the visual output.

7 Claims, 17 Drawing Sheets

U.S. PATENT DOCUMENTS 4,198,068 A 4/1980 Goldfarb et al.
4,280,809 A 7/1981 Greenberg et al.
4,291,489 A 9/1981 McCarthy, Jr.
4,295,294 A * 10/1981 Rosenwinkel et al. ..... 446/144
4,432,159 A 2/1984 Kanno
4,445,297 A 5/1984 D'Andrade et al.
4,508,511 A 4/1985 McQueen
4,509,920 A 4/1985 Kaufmann
4,642,710 A 2/1987 Murtha et al.
4,693,697 A 9/1987 Pagano
4,729,564 A 3/1988 Kuna et al.
D302,186 S 7/1989 Klawitter
4,915,633 A 4/1990 Auer et al.
4,946,416 A 8/1990 Stern et al.
4,976,650 A * 12/1990 Watanabe ..... 446/418
4,997,374 A 3/1991 Simone
5,011,451 A 4/1991 Holtier
5,030,160 A 7/1991 Klawitter
5,045,016 A 9/1991 Stern et al.
5,100,362 A 3/1992 Fogarty et al.
5,209,695 A 5/1993 Rothschild
D349,309 S 8/1994 Thornell
5,346,399 A 9/1994 Sakow
5,401,201 A 3/1995 Muraki
5,407,216 A 4/1995 Liu
5,411,429 A 5/1995 Klawiter
5,429,513 A 7/1995 Diaz-Plaza
5,449,174 A 9/1995 Criner
5,484,288 A 1/1996 DelGigante
5,492,325 A 2/1996 Hawver
5,538,430 A 7/1996 Smith et al.
5,738,526 A 4/1998 Cerda et al.
5,893,817 A * 4/1999 Morgan ..... 482/8
5,931,338 A 8/1999 Hoeting et al.
6,036,573 A * 3/2000 Huang ..... 446/242
D425,946 S 5/2000 Wei
6,074,212 A 6/2000 Cogliano
6,146,146 A 11/2000 Koby-Olson
6,366,869 B1 * 4/2002 Germain ..... 446/453
6,558,224 B2 * 5/2003 Chan ..... 446/219
6,623,405 B2 * 9/2003 Chuang et al. ..... 482/44
2002/0102908 A1 * 8/2002 Chan ..... 446/269
2004/0110326 A1 * 6/2004 Forbes et al. ..... 438/149
2004/0259070 A1 * 12/2004 Goodstein ..... 434/428

* cited by examiner

+4.5VDC
W2
262
SW1A
264
W5
W8
SW2
SW3
228
P1
P2
P3
W1
W3
W4
W7
254
250
LED1
LED2
LED3
LED4
LED5
LED6
LED7
LED8
LED9
LED10
LED11
LED12
LED13
LED14
LED15
LED16
LED17
LED18
LED19
LED20
LED21
LED22
LED23
LED24
LED25
LED26
LED27
LED28
LED29
LED30
Q9
Q11
Q12
Q13
Q14
R20
R21
R22
R23
R24
R25
R26
R27
R28
R29
R30
Q1
Q3
Q4
Q5
Q6
Q7
R14
R15
R16
R17
R18
R19
C3
230
/RESET
U1
R32
C5
+4.5 VDC
R13
Q8
R12
R11
R10
Q10
W10
W11
LP1
292
R3
R4
R5
R6
C4
C1
C2
R2
R9
V1
V2
R8
D1
SW4
R7
Q2
R1
W6
W9
244
240
246
SW18
R31
W12
W13

MOVEABLE TOY WITH CORRESPONDING AUDIO AND VISUAL OUTPUTS

CROSS REFERENCE TO RELATED APPLICATIONS

This application is a continuation of U.S. application Ser. No. 10/347,511, filed Jan. 21, 2003, now U.S. Pat. No. 6,997,773 which is a continuation of U.S. application Ser. No. 10/143,803, filed May 14, 2002, now abandoned which claims the benefit of U.S. Application Ser. No. 60/331,329, filed May 16, 2001, each of which is incorporated herein by reference in its entirety.

BACKGROUND

1. Field of the Invention

The present invention relates generally to toys, and more particularly, to toys with corresponding audio and visual outputs.

2. Discussion of the Related Art

Toys that produce lights and sounds in various patterns have been provided. These toys appeal to young children, because they enjoy watching the lights and listening to the entertaining sounds. Conventional toys have primarily focused on the child's amusement.

A problem with conventional toys is that they tend to focus on entertaining the child while failing to promote the child's educational development such as vocabulary expansion or ability to recite the alphabet or series of numbers. Instead, these toys are primarily designed for one-dimensional use as amusement devices for small children. As the design of toys has progressed, however, parents, teachers, and other individuals involved in child-care have sought toys that provide a multifunctional yet economical approach to child development. Other toys, such as the category of educational learning toys, have provided educational or developmental stimuli, but have been static, immobile products that are less interesting to younger children.

Thus, there is a need for a children's toy that substantially obviates the limitations and disadvantages of conventional children's toys. Particularly, there is a need for an improved approach to the education of young children through a toy which incorporates visual or audible stimuli, such as corresponding lights and sounds that provide an educational experience for the child, while also incorporating movement into the play pattern of the toy to increase interest by the child user.

SUMMARY OF THE INVENTION

The present invention solves the problems with, and overcomes the disadvantages of, conventional children's toys. In particular, the present invention relates to children's toys that produce audio and visual signals when the toy is moved along a support surface. The audio signals correspond to, and are descriptive of, the visual signals.

The invention includes a toy having a body that is adapted to be grasped by a user to propel the toy along a support surface. A motion detector coupled to the body detects motion of the body relative to the support surface and generates a signal indicative of the motion. There is a visual display that is capable of selectively producing a visual output and an audio system capable of selectively producing an audible output corresponding to the visual output. A controller is coupled to the detector, the visual display, and the audio system and is programmed to respond to receipt of the motion indicating signal to cause the visual display to produce the visual output and the audio system to produce the corresponding audible output.

DETAILED DESCRIPTION

Figure 1:
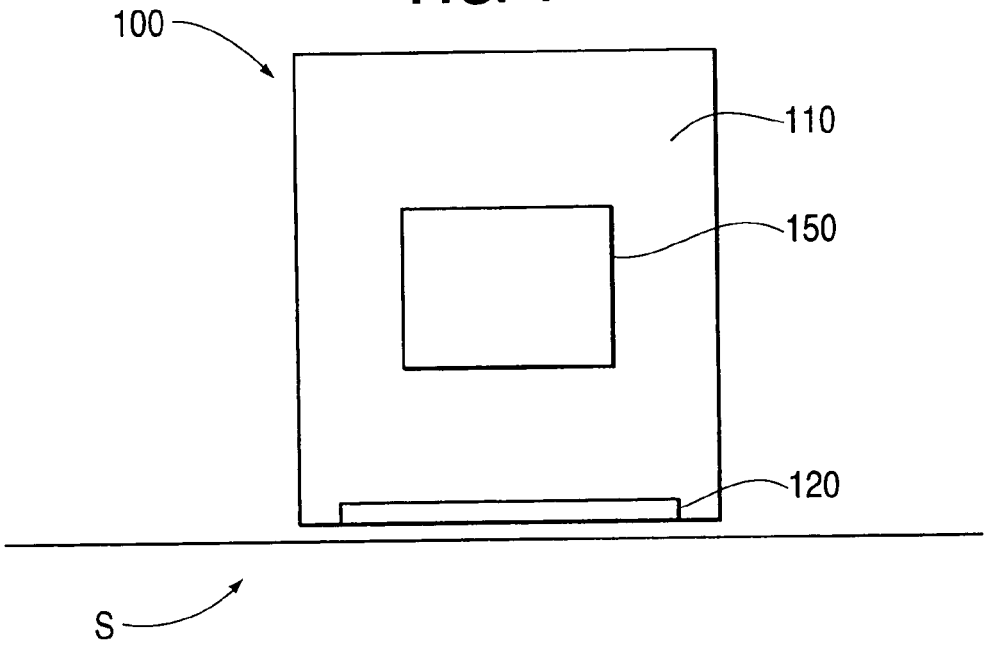
FIG. 1 is a schematic illustration of a generic embodiment of a toy incorporating the principles of the present invention.
Figure 2:
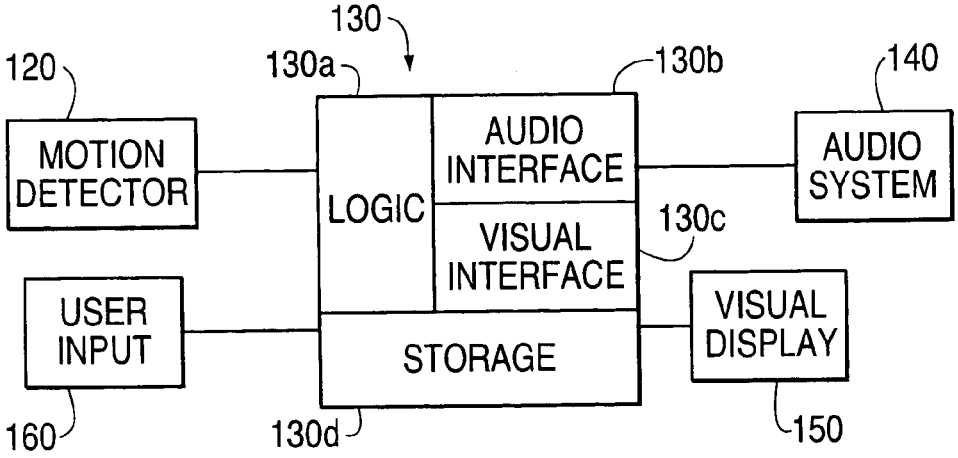
FIG. 2 is a further schematic illustration of the toy illustrated in FIG. 1.
Figure 3:
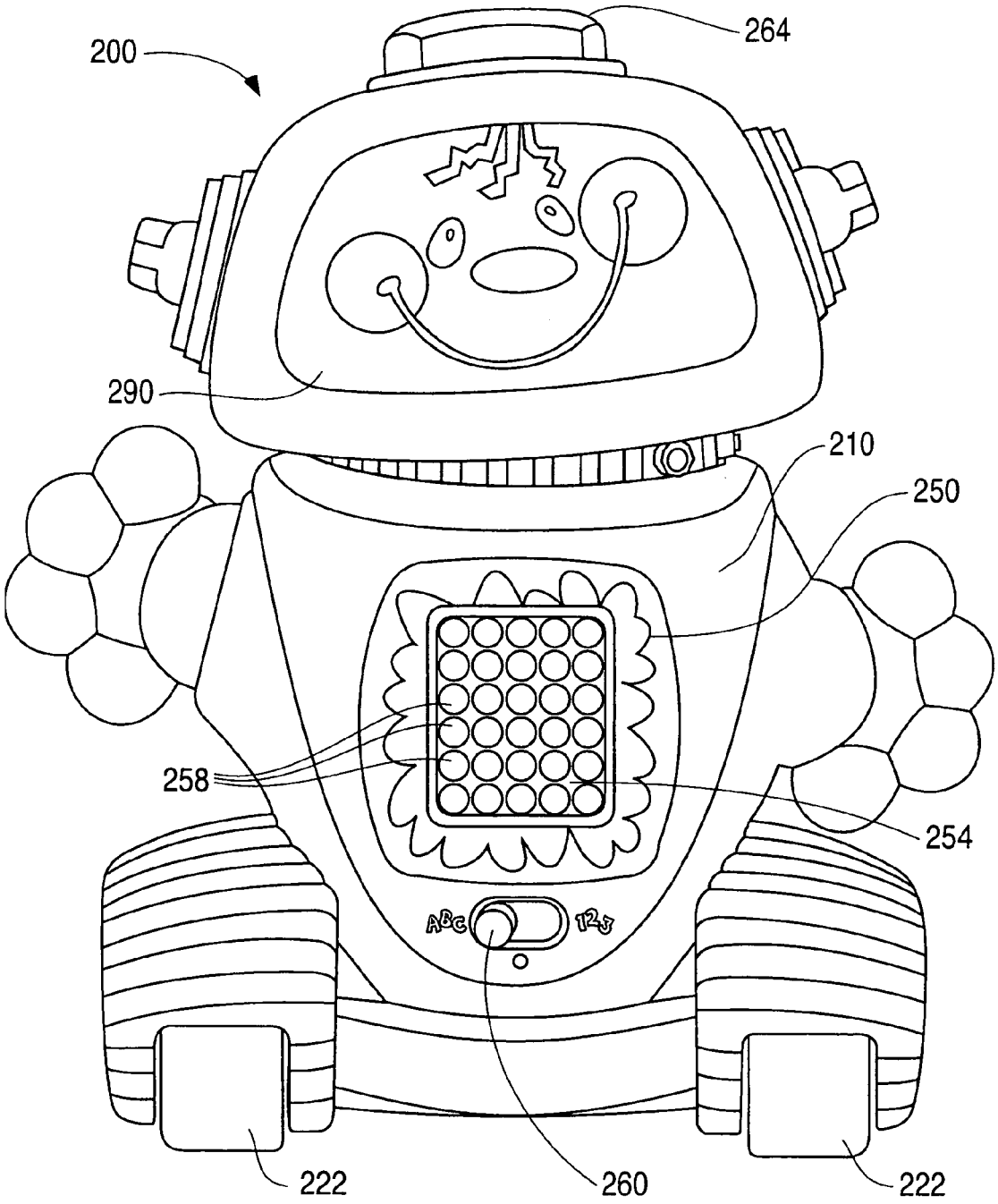
FIG. 3 is a front perspective view of a first implementation of a toy embodying the principles of the present invention.
Figure 4:
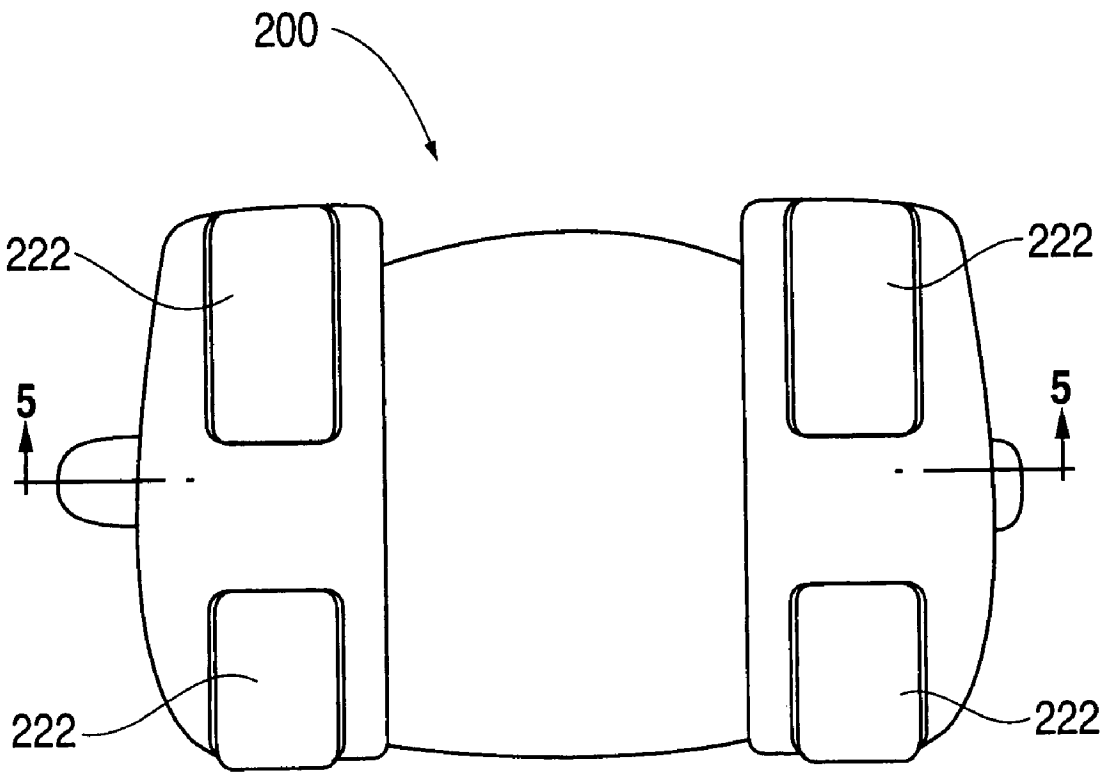
FIG. 4 is a bottom view of the toy illustrated in FIG. 3.
Figure 5:
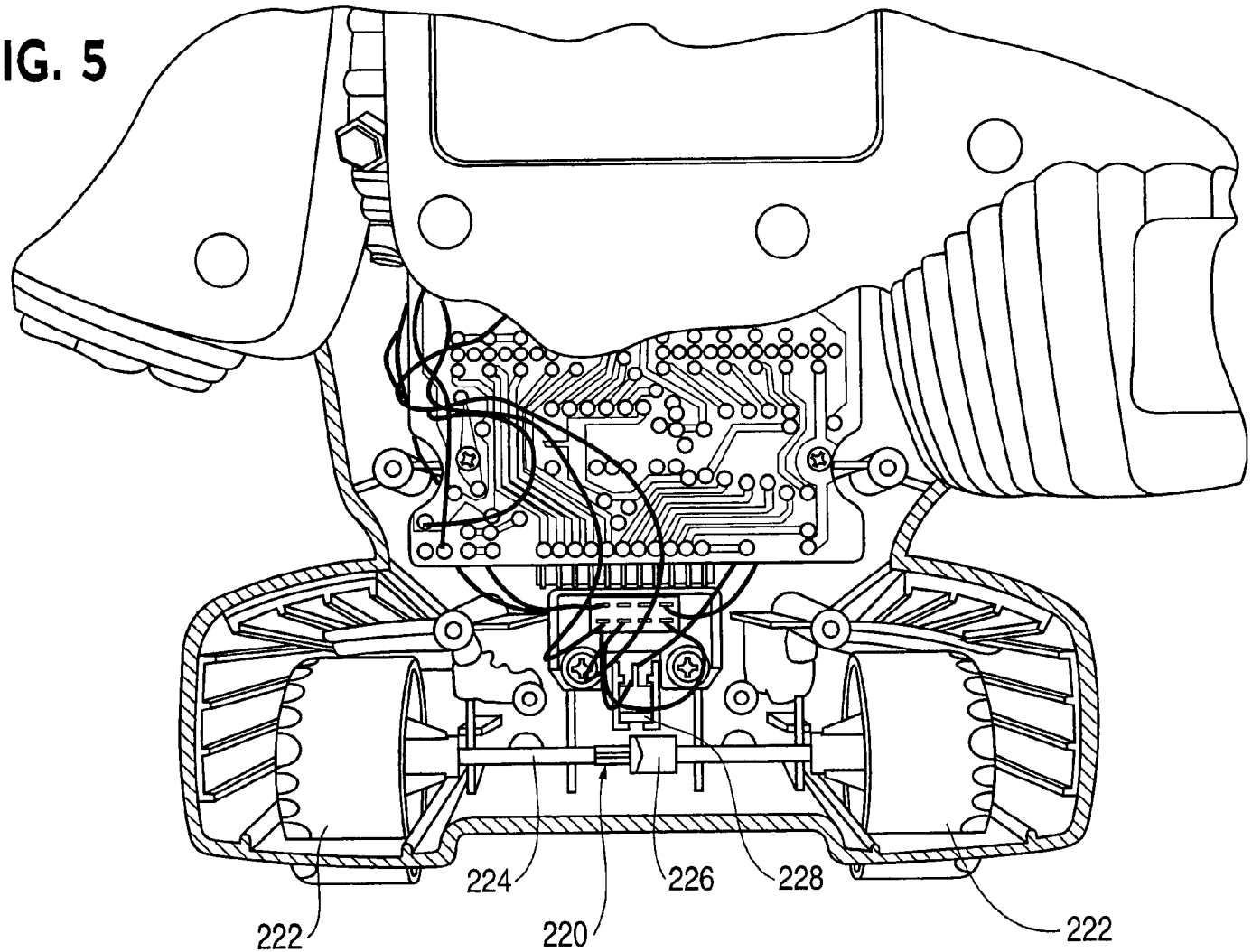
FIG. 5 is a cross-sectional view of the toy illustrated in FIG. 3 taken along the line 5-5 in FIG. 4.

FIGS. 1 and 2 are schematic illustrations of a generic embodiment of a moveable toy 100 with corresponding audio and visual outputs. The toy 100 includes a body 110 that is adapted to be grasped by a user to propel the toy along a support surface S. The toy 100 can be either pushed or pulled by the user, but is configured such that it moves over the support surface S. A motion detector 120, such as a momentary switch or an optical motion sensor, is coupled to the body 110 to detect motion of the body 110 relative to the support surface S. Upon detecting relative motion, the motion detector 120 generates a signal indicative of the motion. The signal generated by the motion detector 120 may simply be a signal indicative of motion in any direction. Optionally, the signal generated by the motion detector may indicate the fact that motion is taking place and may also indicate the direction of the motion. The motion detector 120 may take many forms, as will be described below in detail, provided that it is capable of detecting motion of the body 110 over the support surface.

A visual display 150 is coupled to the body 110 that is capable of selectively producing a visual output. The visual display 150 may be integrally coupled with the body 110 or removably coupled to the body 110. Moreover, the visual display 150 may be mounted within an opening in the body 110, coupled externally to the body 110 or otherwise mounted such that the user readily views the visual display 150 when the toy 100 is in operation. The visual display 150 may be configured such that the user can view the visual display 150 while the body 110 is in motion as well as when the body 110 is at rest. Optionally, the visual display may be configured such that the user can only view the visual display 150 when the toy is at rest or only when the toy is in motion. The visual display 150 is that part of the toy 100 that presents the desirable visual image for the user to view.

An audio system 140 is included in the toy 100 that is capable of selectively producing an audible output corresponding to the visual output. The audio output corresponds to the visual output in the sense that the audio output is descriptive of the visual output, logically related to the visual output or both descriptive of and logically related to the visual output. For example, as will be described in detail below, if the visual output is a letter of the alphabet or a number, the audio output may be the spoken pronunciation of that displayed letter or number. The audible output can be any word or may be a particular tone or sequence of tones. The audible output may be produced and output simultaneously with the visual output. Optionally, the audible output may be produced and output before or after the visual output.

The relationship of various components of the toy 100 are schematically illustrated in FIG. 2. A controller 130 cooperates with the motion detector 120, the visual display 150, and the audio system 140 and is programmed to respond to receipt of the motion signal from the motion detector 120. The controller may also be responsive to input from a user of the toy 100 via user input 160. The controller 130 causes the visual display 150 to produce the visual output and similarly causes the audio system 140 to produce the corresponding audible output. The audio and visual outputs can be produced in a particular sequence or may be produced in a random manner provided the audible output corresponds to the visual output. The controller 130 can include memory or storage 130*b* in which the audible and visual output information can be stored, logic 130*a* (e.g., stored control software) that controls the operation of controller 130, appropriate interfaces to the audio system 140 (e.g., speech synthesizer circuitry, audio amplifier, etc.) and visual display 150.

Various physical implementations of this generic schematic description of the invention are described below. Corresponding reference numerals are used to reference structures in these implementations that correspond to the elements of the generic description above.

A first embodiment of the invention, representing a first physical implementation of the generic embodiment as described above, is illustrated in FIGS. 3-6 in which a toy 200 includes a body 210 that is supported by wheels or rollers 222 that are supported by an axle 224. The body 210 may be in the form of a robot (as illustrated) or may be any other form that is entertaining to children. The toy 200 can be either pushed or pulled by the user, but is configured such that is translates over the support surface S on wheels 222.

A motion detector 220 operates with the axle 224 to detect motion of the body 210 relative to the support surface S. The motion detector 220 includes an eccentric 226 mounted to the axle 224 and a switch 228 that is actuated by eccentric 226. Eccentric 226 is a cam with a plurality of lobes that are able to actuate the switch 228. As the wheels 222 roll over the support surface S, the axle 224 rotates, thereby rotating the eccentric 226. As each lobe engages the normally open switch 228, the switch closes, generating a signal detected by controller 230. The number of lobes on the eccentric 226 will determine how many times the switch 228 will be actuated per rotation of the wheels 222. Optionally, a user of the toy 200 may spin the wheels 222 manually to activate the switch 228 instead of moving the toy 200 across the support surface.

A visual display 250 is mounted to the front face of the body 210 and is capable of selectively producing a visual output. In this embodiment, the visual display 250 is implemented as an array 254 of light emitting diodes (LEDs) 258 that are selectively activated to produce images on the visual display 250. As will be appreciated, the visual display 250 for this embodiment of toy 200 may be implemented with other types of displays that are capable of producing various images from a matrix of pixels such as, for example, a Liquid Crystal Display (LCD).

Audio system 240 is included in the toy 200 that is capable of selectively producing an audible output corresponding to the visual output. The audio system 240 includes a speaker 244 mounted within the body 210 that is capable of emitting various sounds produced by the toy 200 as will be described in greater detail. The audio system 240 may also include a volume control 246 (switch SW4 in FIG. 6) that is moveable between a first position V1 and a second position V2. When the volume control 246 is in the first position V1, the volume of the audio output is lower than when the volume control is in the second position V2. There may be multiple positions for the volume control to more selectively control the volume as known to those skilled in the art.

A controller 230 controls the output of sounds and lights from toy 200. The controller 230 includes a controller logic that is stored in a memory of the controller 230. The memory also stores the audio content and visual content that is ultimately output by the toy 200. The controller 230 is configured to produce select audio and visual output in predetermined sequences according to the programming of the controller logic as would be apparent to those skilled in the art. Optionally, the controller 230 may be configured to produce the audio and visual output in a random fashion. An example of a controller that can be used in the present invention is the SPC251 A that is available from Sunplus Technology Company, Ltd. Alternative processors or controllers may be utilized provided they are capable of producing corresponding audio and visual output as intended by the present invention.

The toy 200 includes user input 260 via which the user can provide input to effect the operation of toy 200. User input 260 includes a mode selector 262 and an actuator 264. Various modes of operation are alternatively selectable by mode selector 262 implemented as a switch (illustrated as SW1A in FIG. 6). In one mode of operation, when the switch SW1A is in a first position P1, controller 230 causes letters of the alphabet to be displayed on the visual display 250 by illuminating particular patterns of LEDs. The letters of the alphabet may be displayed sequentially or, optionally, may be displayed randomly. As each letter is displayed on the visual display 250, the audio system 240 produces an audio output corresponding to the displayed letter, such as a spoken pronunciation of the letter. The display 250 and the audio output are activated when the switch 228 is actuated. The controller 230 causes the display 250 to change to a different letter of the alphabet each time the switch 228 is closed.

The toy 200 includes an actuator 264 that may be used to activate the display 250 and the audio system 240. Actuator 264 is implemented as a large button atop the robot's "head", which, when depressed by the user, closes a switch SW2 and sends a corresponding input signal to the controller 230. Each actuation of the actuator 264 causes the display of a subsequent letter of the alphabet as well as the spoken pronunciation of that displayed letter. Optionally, each actuation of the actuator 264 can cause the display of multiple letters and the corresponding spoken pronunciations of those displayed letters. Moreover, actuation of the actuator 264 may cause the audio system to produce a different output corresponding to the visual output, such as the spoken pronunciation of a word that begins with the displayed letter.

In an alternative mode of operation, with the mode switch SW1A in a second position P2, numbers may be displayed on the visual display 250 by illuminating particular patterns of LEDs. The numbers may be displayed sequentially or, optionally, may be displayed randomly. As each number is displayed on the visual display 250, the audio system 240 produces an audio output corresponding to the displayed number, such as a spoken pronunciation of the displayed number. The display 250 and the audio output are activated when the switch 228 is actuated. The controller 230 causes the display 250 to display a subsequent number each time the switch 228 is closed.

The actuator 264 may cause the display of subsequent numbers as well as the spoken pronunciation of the displayed number. Optionally, each actuation of the actuator 264 can cause the display of multiple numbers and the corresponding spoken pronunciations of the displayed numbers. Moreover, if the actuator 264 is actuated multiple times, the audio system 240 may be caused to produce an output such as a sequence of tones representing the displayed number. Similarly, the display 250 may illuminate individual LEDs each time a tone is played that represents the number that was previously displayed.

In a further mode of operation, shapes may be displayed on the visual display 250 by illuminating particular patterns of LEDs. The shapes may be displayed in a predetermined fashion or may be displayed randomly. As each shape is displayed on the visual display 250, the audio system 240 produces an audio output corresponding to the displayed shape such as a spoken pronunciation of the displayed shape. The display 250 and the audio output are activated when the switch 228 is actuated. The toy 200 can cycle through a different shape each time the switch 228 is closed. While the modes of operation may be selected by the user by changing the position of the mode switch 260, it is also possible for the toy 200 to randomly choose the mode of operation. Optionally, the mode of operation may be based on the speed or direction with which the toy 200 moves.

Using the toy 200, a child is provided with entertainment as well as the opportunity to learn letters, numbers and shapes.

The toy 200 may also include facial features 290 that can be illuminated such as by a bulb 292 when the audio system 240 produces an output to give the appearance that the toy 200 is speaking. Optionally, the facial features 290 may be moveable to give a more realistic appearance that the toy 200 is speaking.

Figure 6:
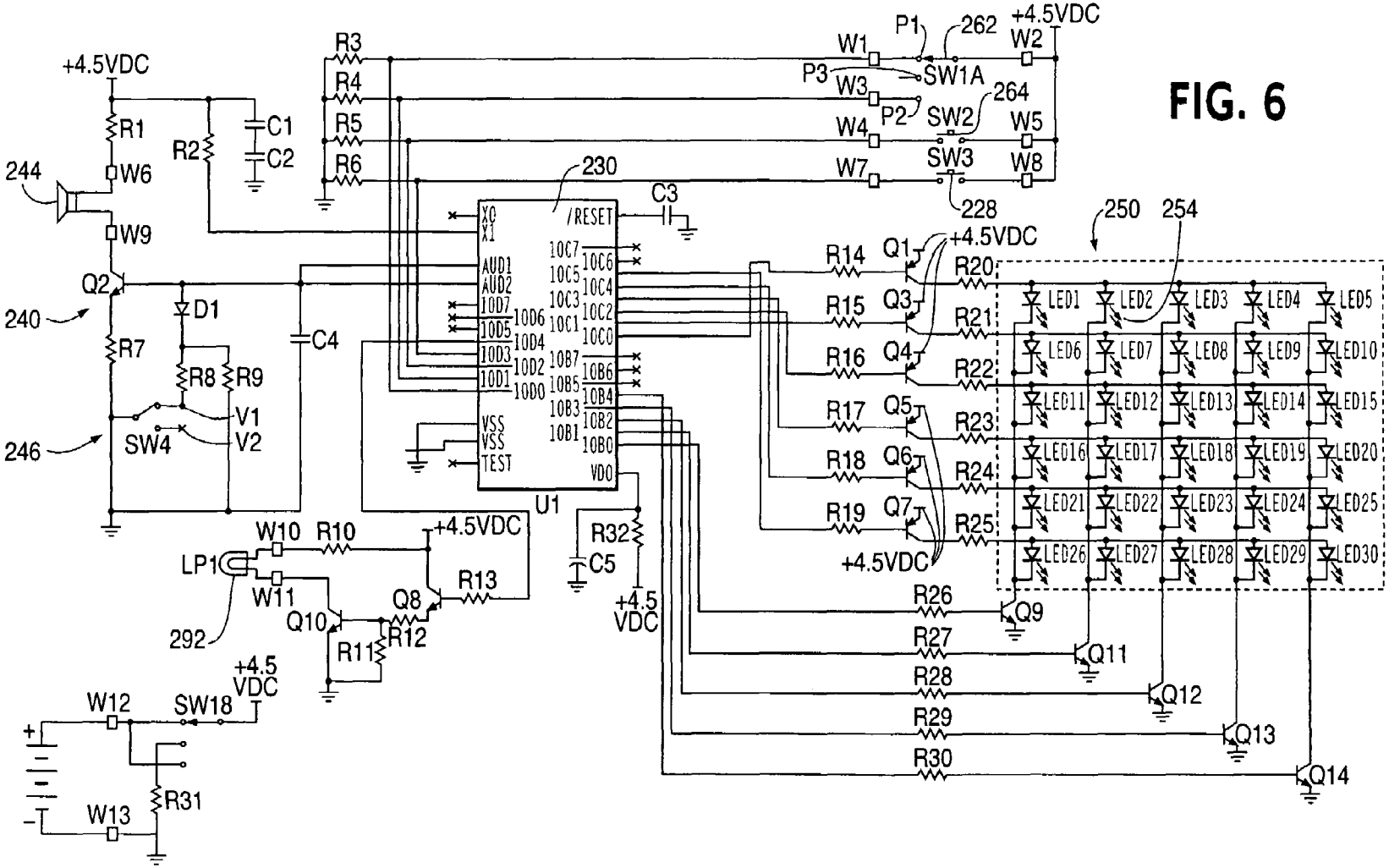
FIG. 6 is a schematic illustration of the toy illustrated in FIG. 3.
Figure 7:
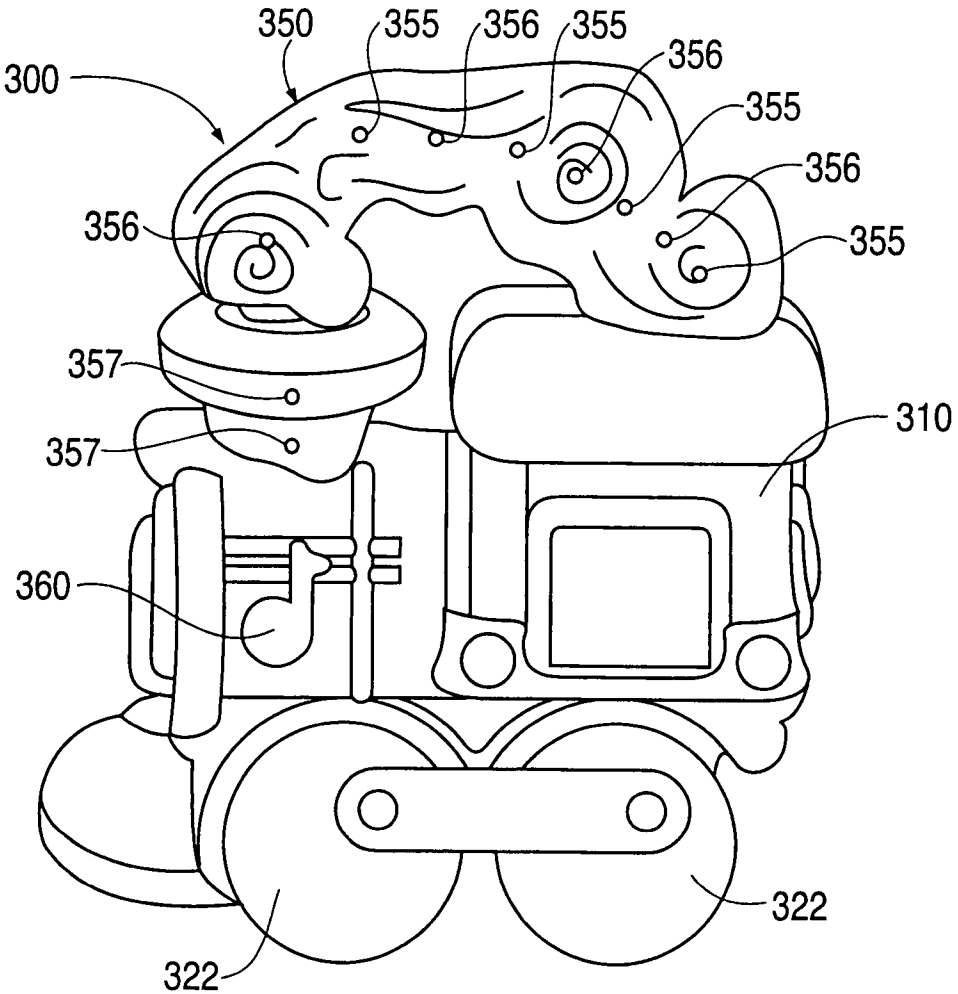
FIG. 7 is a perspective view of a second implementation of a toy embodying the principles of the present invention.
Figure 8:
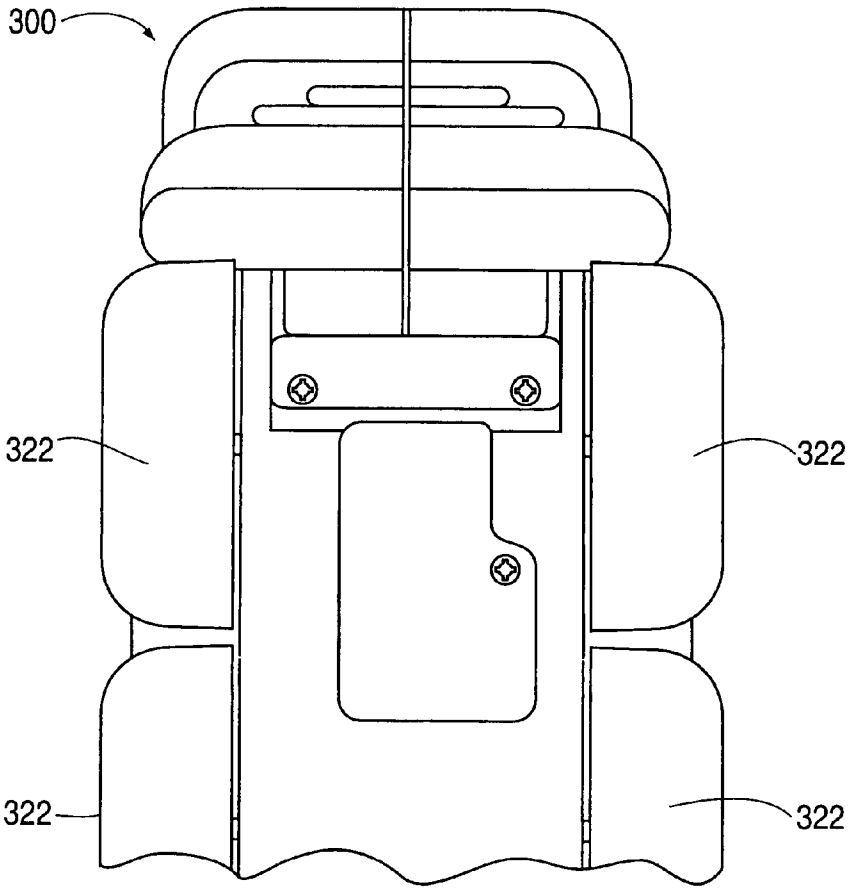
FIG. 8 is a bottom view of the toy illustrated in FIG. 7.
Figure 9:
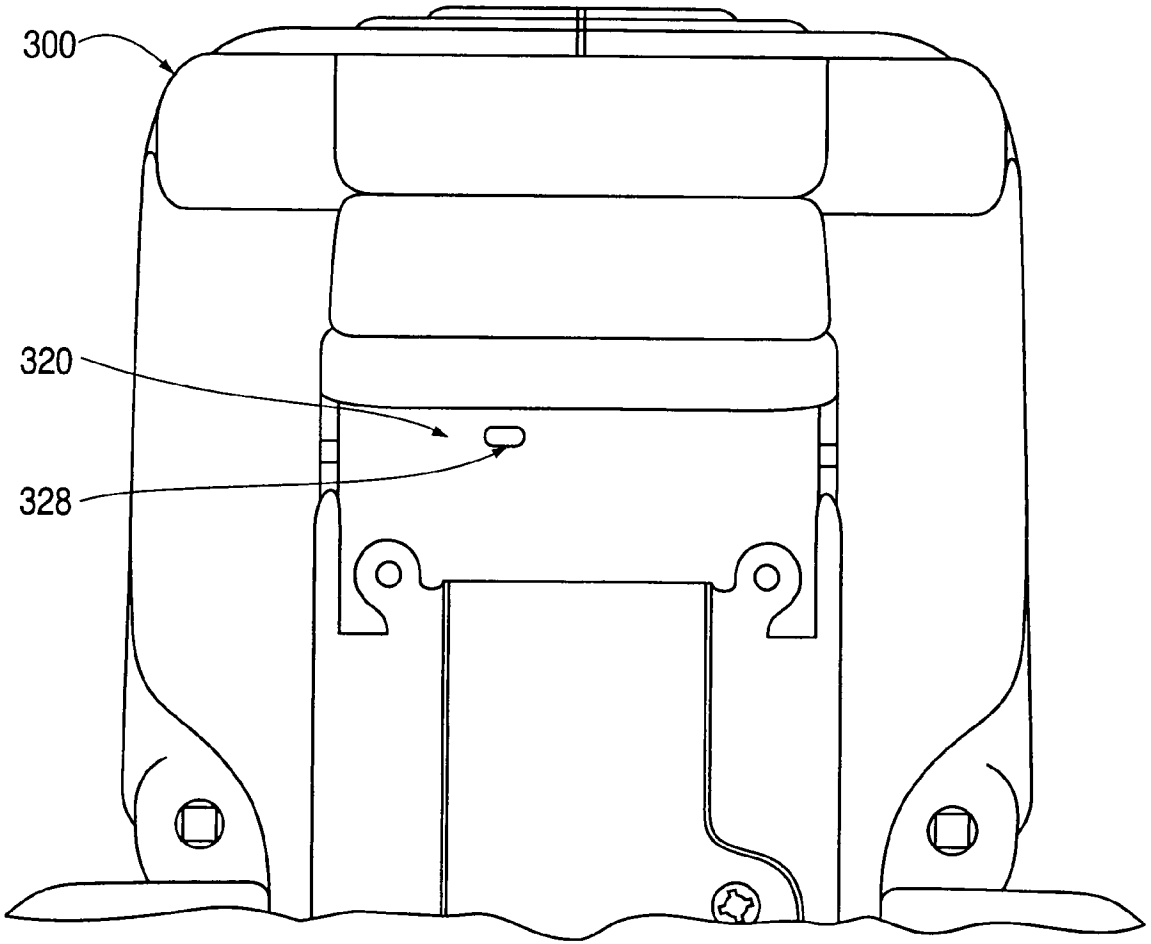
FIG. 9 is a partial cut away view of the toy illustrated in FIG. 7.
Figure 10:
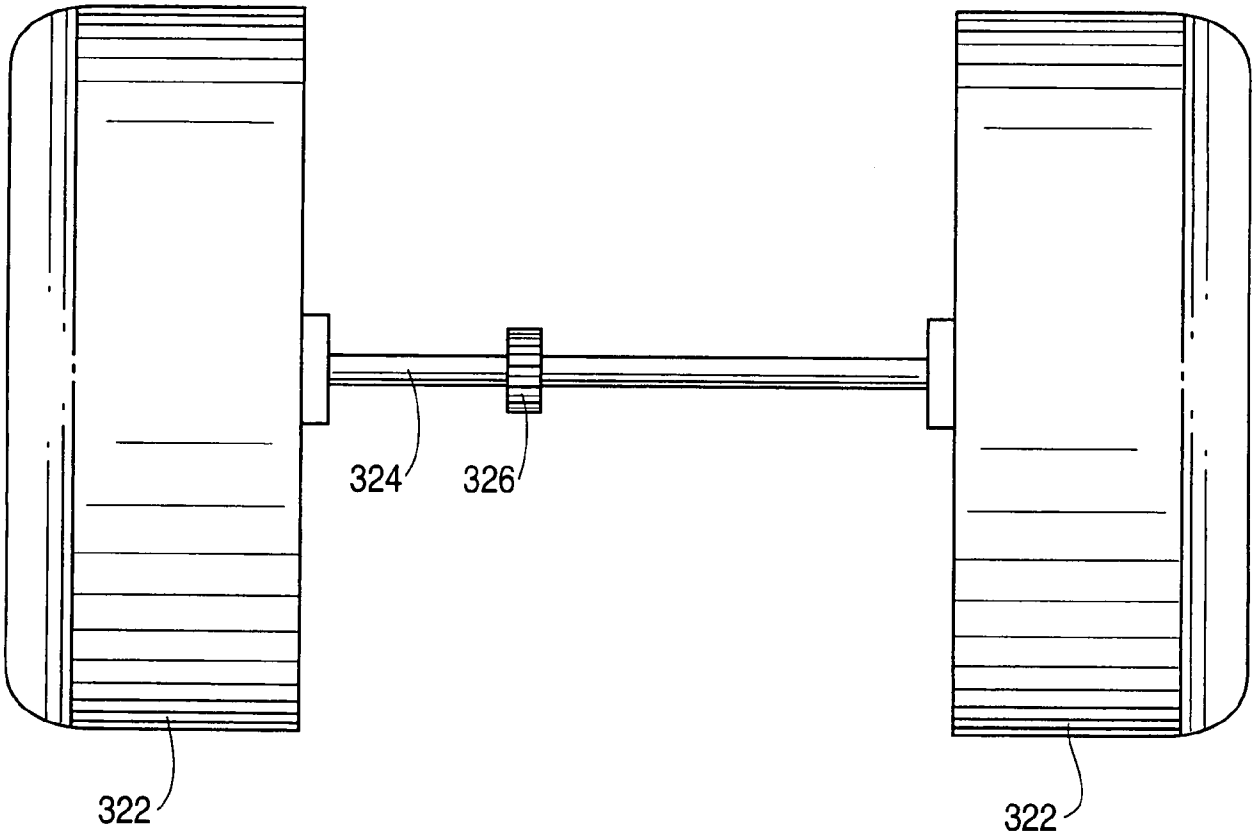
FIG. 10 is a rear view of a component of the toy illustrated in FIG. 7.

The relationships among various components of the toy 200 are schematically illustrated in FIG. 6. The controller 230 cooperates with the motion detector switch 228, the LED array 254, and the audio system 240, and is programmed to respond to receipt of the motion signal from the motion detector switch 228 as described above. The controller 230 causes the visual display 250 to produce the visual output and similarly causes the audio system 240 to produce the audible output that corresponds to, and is descriptive of, the image on the visual display. The audio and visual outputs can be produced in a particular sequence or may be produced in a random manner provided the audible output corresponds to the visual output.

The output of the visual display 250 may be dependent upon the position of the mode switch 260 as described above. With the mode switch SW1A in the first position P1, the controller 230 produces a display of letters on the LED array 254. With the mode switch in the second position P2, the controller 230 produces a display of numbers. When the mode switch is in the third position P3, the toy 200 is in the off position, and no power is delivered to the controller. More positions may be provided that would allow further modes of operation.

A second embodiment of the invention, representing a second physical implementation of the generic embodiment described above, is illustrated in FIGS. 7-11 in which the toy 300 includes a body 310 that is supported by wheels or rollers 322 that are supported by axles 324. The body 310 may be in the form of a train (as illustrated) or may be any other form that is entertaining to children. The toy 300 can be either pushed or pulled by the user, but is configured such that is translates over the support surface S on wheels 322.

A motion detector 320 operates with axle 324 to detect motion of the body 310 relative to the support surface S. The motion detector 320 includes an eccentric 326 mounted to the axle and a switch 328 actuated by eccentric 326. Eccentric 326 is a cam with a plurality of lobes that are able to actuate the switch 328. For example the eccentric may be oval, triangular, rectangular, or square in shape. As the wheels 322 roll over the support surface S, the axle 324 rotates, thereby rotating the eccentric 326. As each lobe engages the normally open switch 328, the switch closes, generating a signal detected by controller 330. The number of lobes on the eccentric 326 will determine how many times the switch 328 will be actuated per rotation of the wheels 322. Optionally, a user of the toy 300 may spin the wheels 322 manually to activate the switch 328 instead of rolling the toy 300 across the support surface.

A visual display 350 is coupled to the body 310 and is capable of selectively producing a visual output. In this embodiment, the visual display 350 is implemented as a string 354 of light emitting diodes (LEDs) 355, 356, 357 that are selectively activated. The LEDs 355, 356, 357 may be different colors. For example, there may be one or more red LEDs 355, one or more green LEDs 356, and one or more blue LEDs 357.

An audio system 340 is capable of selectively producing an audible output corresponding to, and descriptive of, the visual output. Audio system 340 includes a speaker 344 mounted within the body 310 that is capable of emitting various sounds produced by the toy 300 as will be described in greater detail.

A controller 330 controls the output of sounds and lights from toy 300. The controller 330 includes a controller logic that is stored in a memory of the controller 330. The memory also stores the audio content and visual content that is output by the toy 300. The controller 330 is configured to produce select audio and visual output in predetermined sequences according to the programming of the controller logic as would be apparent to those skilled in the art. Optionally, the controller 330 may be configured to produce the audio and visual output in a random fashion. An example of a controller that can be used in the present invention is the EMC 58200 that is available from Elan Microelectronics Corporation. Alternative processors or controllers may be utilized provided they are capable of producing corresponding audio and visual output as intended by the present invention.

In one mode of operation of the toy 300, as the toy 300 is moved across the support surface S, controller 330 causes the string 354 of LEDs of the visual display 350 to be illuminated in a predetermined sequence. Optionally, the LEDs of the string 354 are illuminated in a random fashion. A single LED is illuminated each time the switch 328 is actuated. Optionally, the entire series of LEDs is illuminated with each actuation of the switch 328. Audio system 340 produces an output corresponding to the displayed color such as a spoken pronunciation of the color of the LED that is illuminated. For example, each time a red LED 355 is illuminated, the audio output 340 produces a spoken pronunciation of the word "RED." Similarly, each time a green LED 356 is illuminated, the audio output 340 produces a spoken pronunciation of the word "GREEN." Finally, each time a blue LED is illuminated, the audio output 340 produces a spoken pronunciation of the word "BLUE." In this manner, the child using the toy 300 is provided an entertaining experience as well as the opportunity to learn certain colors.

The toy 300 includes a user input 360 via which the user can provide input to effect the operation of toy 300. User input 360 includes an actuator 364 that may be used to activate the display 350 and the audio system 340. The actuator 364 is implemented as a button on the "stack" of the train, which when depressed by the user, closes a switch (illustrated as SW2 in FIG. 11) and sends a corresponding input signal to controller 330. Actuation of the actuator 364 causes the LEDs 355, 356, 357 to illuminate and causes the audio system to play a series of musical notes. Optionally, a single actuation of the actuator 364 may cause the LEDs 355, 356, 357 to illuminate in succession while the audio system 340 produces a spoken pronunciation of the color of each LED 355, 356, 357. Moreover, actuation of the actuator 364 may cause the audio system 340 to produce a different output corresponding to the visual output such as the spoken pronunciation of the position of the illuminated LED with respect to the body of the train (i.e., front, middle, back).

Figure 11:
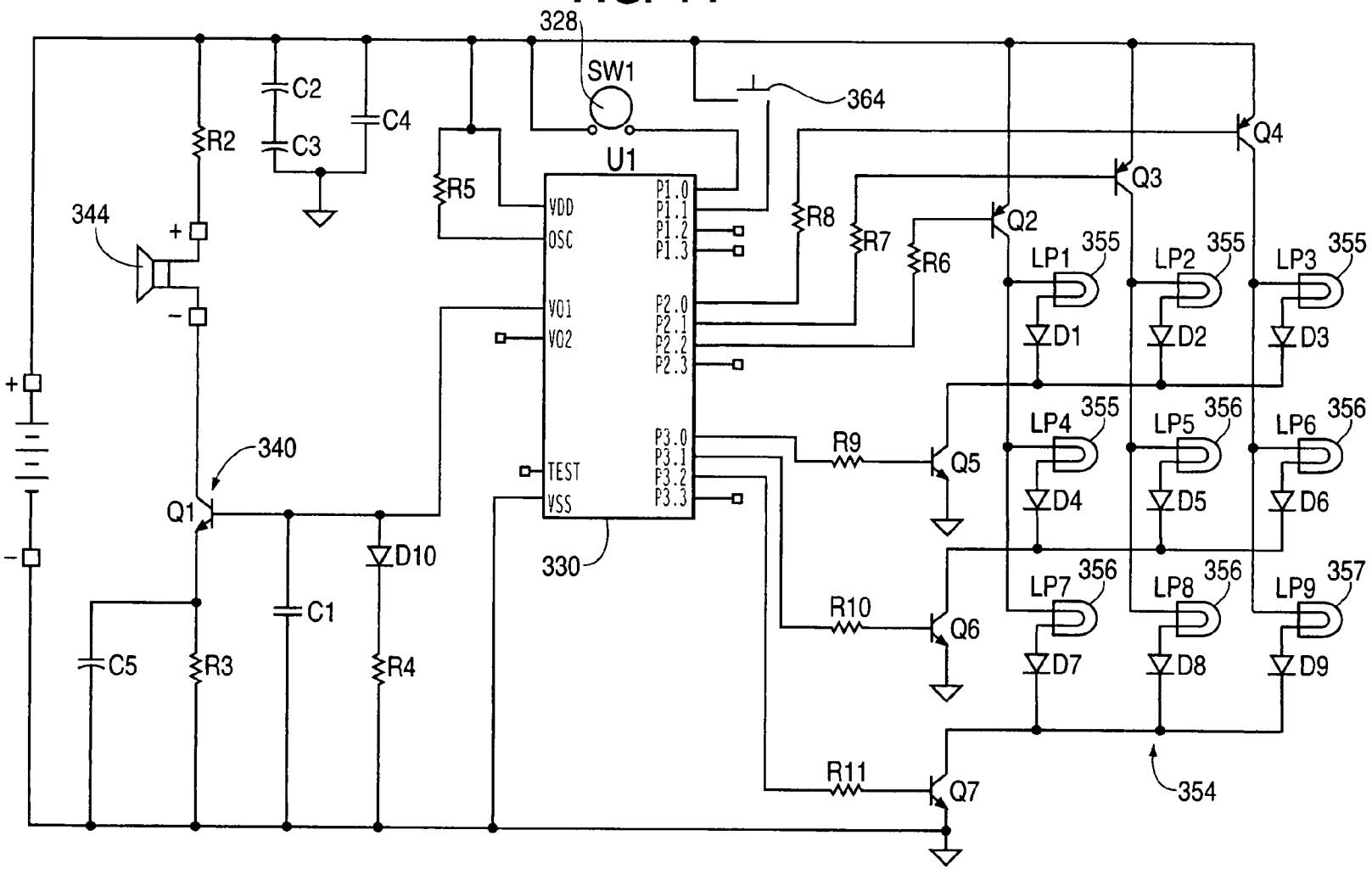
FIG. 11 is a schematic illustration of the toy illustrated in FIG. 7.
Figure 12:
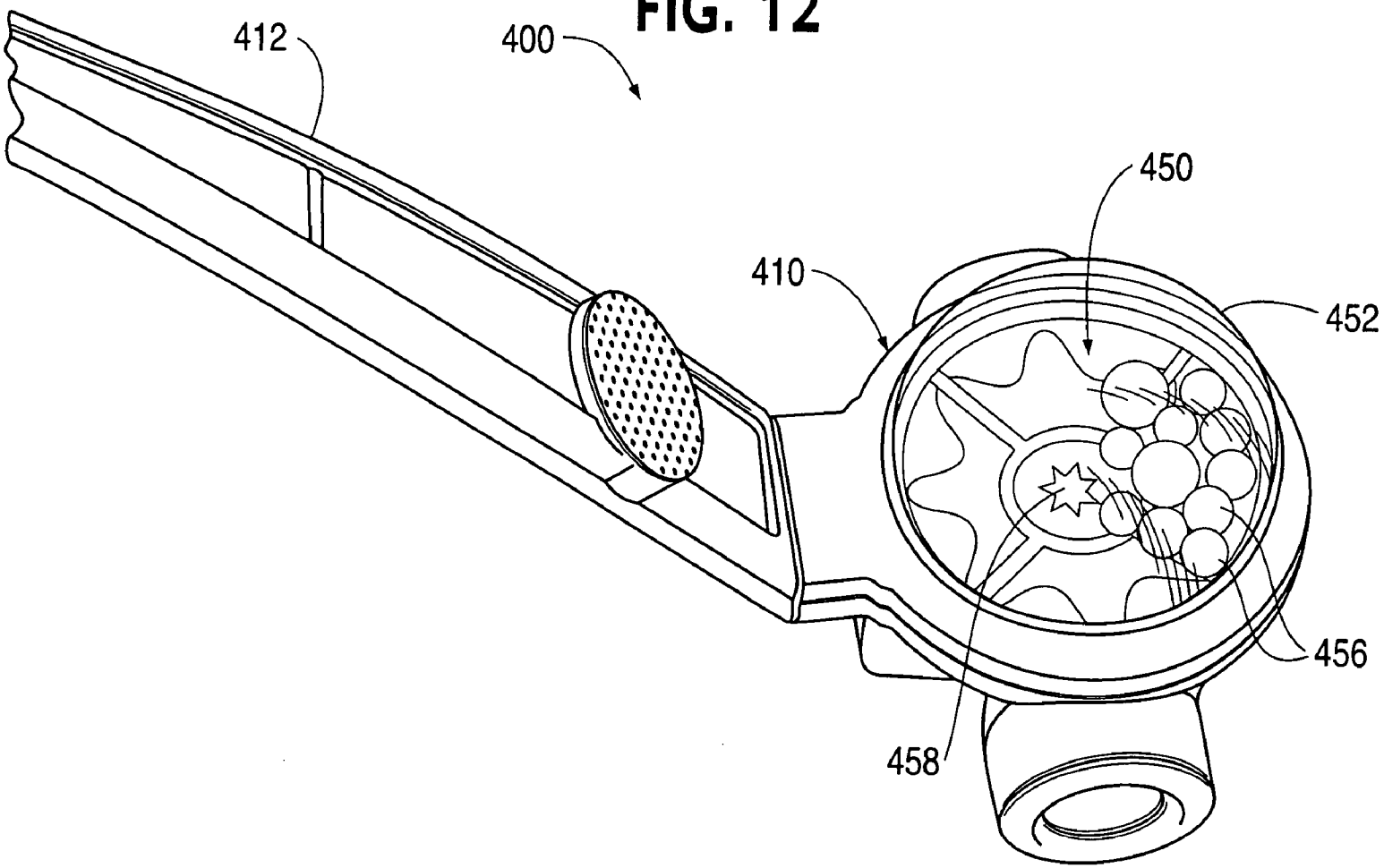
FIG. 12 is a perspective view of a third implementation of a toy embodying the principles of the present invention.
Figure 13:
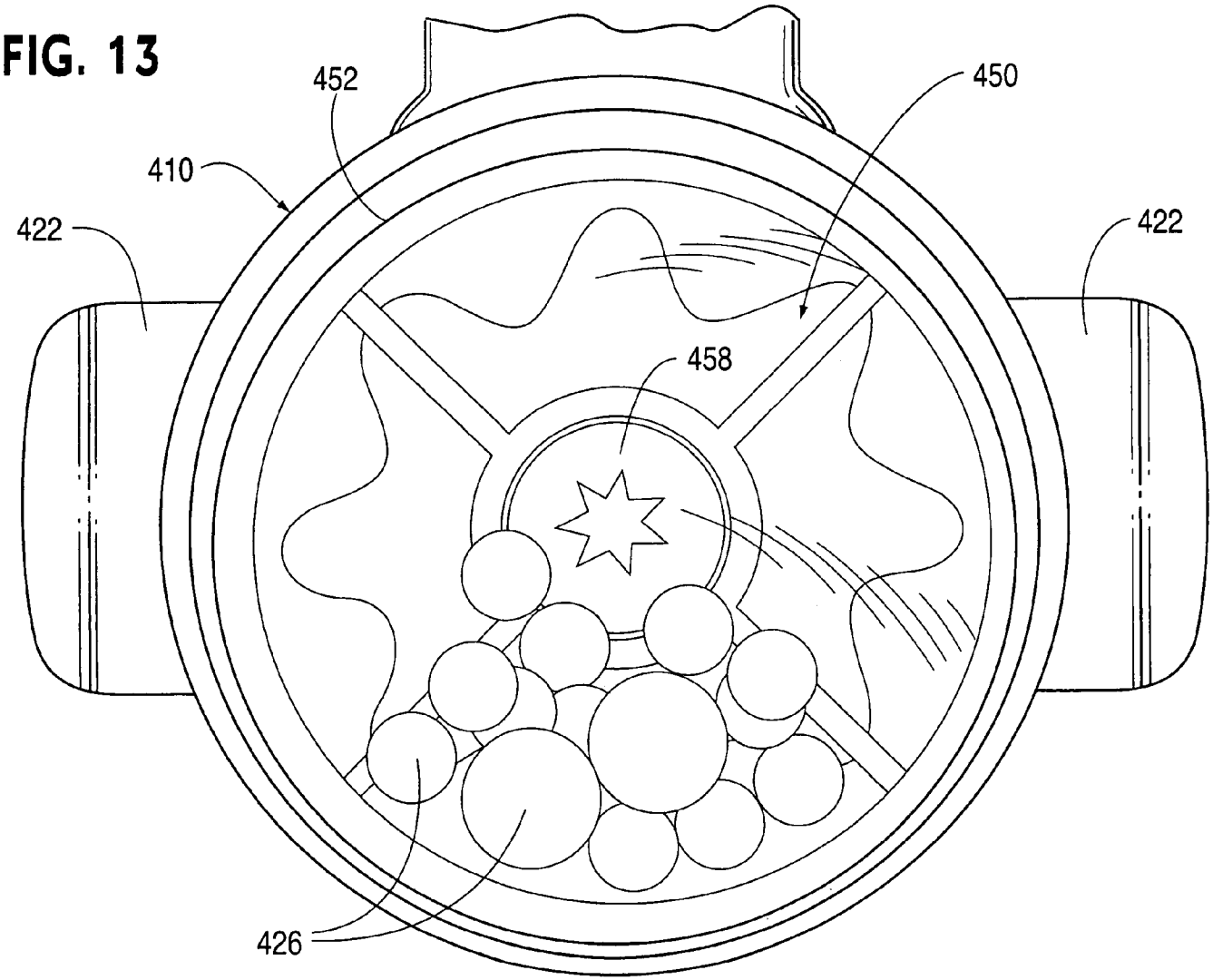
FIG. 13 is a partial top view of the toy illustrated in FIG. 12.
Figure 14:
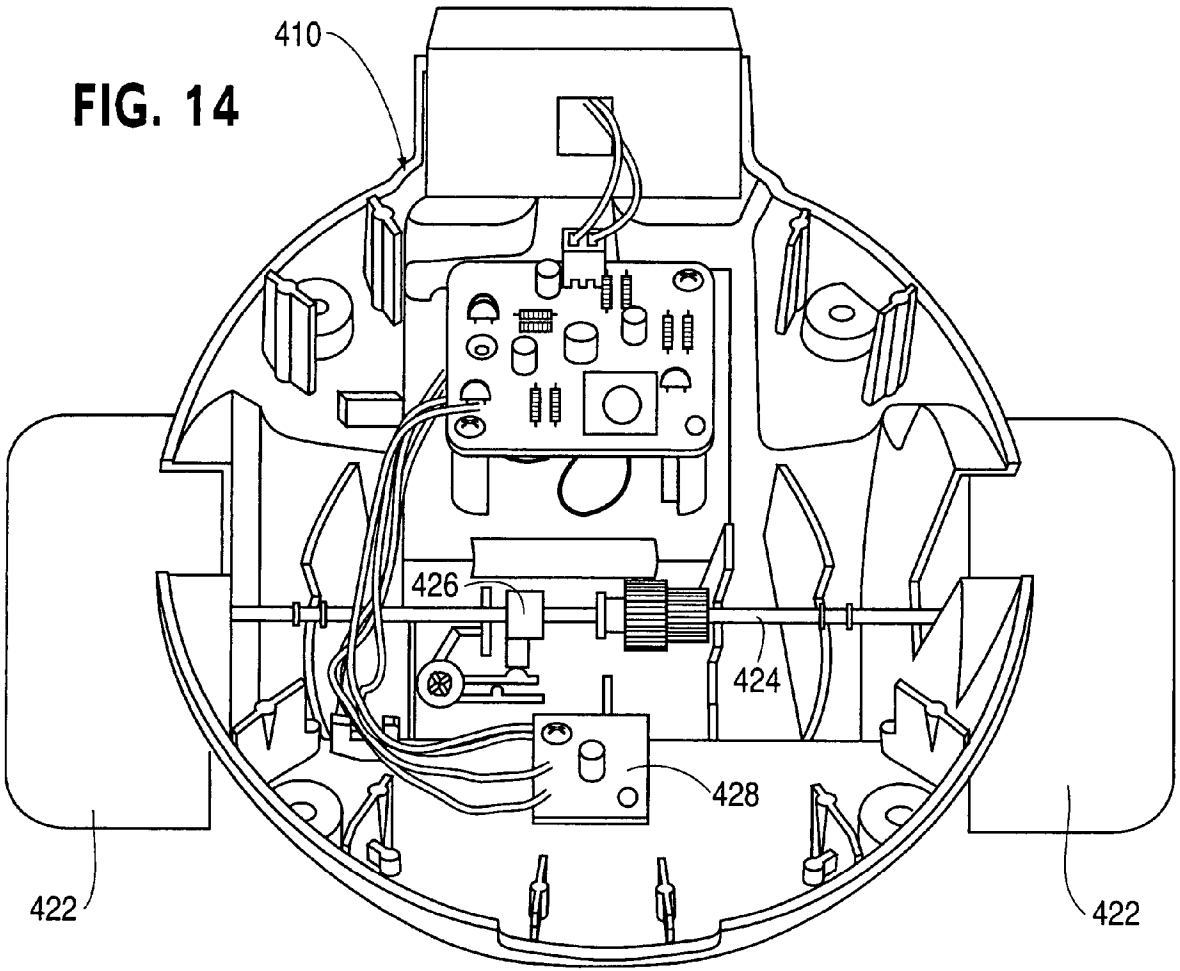
FIG. 14 is a partial cross-sectional view of the toy illustrated in FIG. 12 taken along the line 14-14 in FIG. 13.
Figure 15:
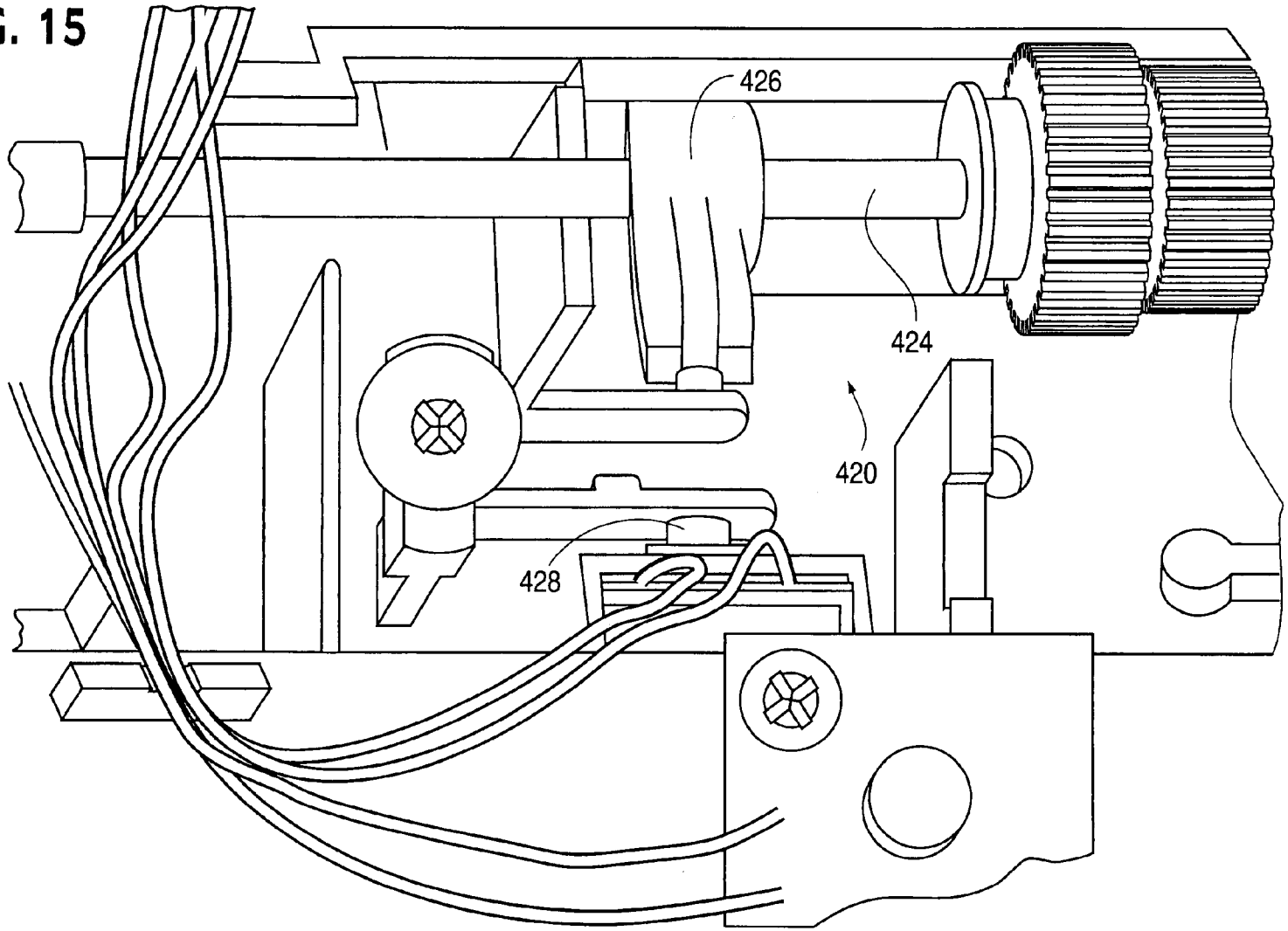
FIG. 15 is a detailed view of section 15 in FIG. 14.

The relationships among various components of the toy 300 are schematically illustrated in FIG. 11. The controller 330 cooperates with the motion detector switch 328, the visual display 350, and the audio system 340, and is programmed to respond to receipt of the motion signal from the motion detector switch 328. The controller 330 causes the visual display 350 to produce the visual output and similarly causes the audio system 340 to produce the corresponding audible output. The audio and visual outputs can be produced in a particular sequence or may be produced in a random manner provided the audible output corresponds to the visual output.

A third embodiment of the invention, representing a third physical implementation of the generic embodiment described above is illustrated in FIGS. 12-15 in which a toy 400 includes a body 410 that is supported by wheels or rollers 422 that are supported by an axle 424. The body 410 may be in the form of a conventional popper toy (as illustrated) or may be in another form that is appealing to children. The toy 400 can be either pushed or pulled by the user via the handle 412 and is configured such that is translates over the support surface S on wheels 422.

A motion detector 420 operates with axle 424 to detect motion of the body 410 relative to the support surface S. The motion detector 420 includes an eccentric 426 that is mounted to axle 424 and triggers an actuator 458 and a switch 428. Eccentric 426 is a cam with a plurality of lobes that are able to trigger the actuator 458 and actuate the switch 428. As the wheels 422 roll over the support surface S, the axle 424 rotates, thereby rotating the eccentric 426. As each lobe engages actuator 458 and normally open switch 428, the actuator 458 is triggered and the switch closes, generating a signal detected by controller 430. The number of lobes on eccentric 426 will determine how many times the actuator will be triggered and how many times the switch 428 will be actuated per rotation of the wheels 422. Optionally, a user of the toy 400 may spin the wheels 422 manually to actuate the switch 428 instead of rolling the toy 400 over the support surface.

A visual display 450 is coupled to the body 410 and is capable of selectively producing a visual output. In this embodiment, the visual display 450 is implemented as an enclosure 452 and objects 456 that are mobilized by the actuator 458. When the actuator 458 is triggered, it is withdrawn and subsequently forced forward under the force of a spring (not shown). Once triggered, the actuator 458 causes the objects 456 within the enclosure to move randomly around the enclosure 452. The visual display 450 may also include lights that are actuated by the switch 428.

Each time the switch 428 is actuated, the controller 430 causes the audio system 440 to produce an audio output corresponding to the number of times the switch 428 has been actuated within a particular time frame such as a spoken pronunciation of the number of times the switch 428 has been actuated. The same number that is output by the audio system corresponds to the number of times that the actuator 458 has been triggered. The actuation of switch 428 and the triggering of the actuator 458 can be simultaneous or may be slightly delayed. In either case, the spoken pronunciation of the number of times the switch 428 has been triggered corresponds to the number of times the actuator 458 has been triggered or will be triggered. The toy 400 may be configured to only count up to a predetermined number. For example, the audio system 440 may only output the spoken pronunciation of numbers up to ten and then start over at number one.

In one embodiment, if the velocity of the toy 400 is less than a predetermined speed, the audio system 440 will perform as described above by outputting the spoken pronunciation of the number of times the switch 428 is actuated. In the event that the toy's velocity exceeds a predetermined velocity, the toy plays a series of musical notes. This is to eliminate speech counting and mechanical ball popping asynchronicity that may result at high velocities of the toy 400.

The velocity of the toy 400 is measured by the number of actuations of switch 428. Upon completion of either the current spoken pronunciation or musical note segment, if the velocity of toy 400 decreases below a predetermined threshold value (i.e., more than a predetermined time elapses without an actuation of switch 428) the toy 400 enters a wait mode period for a predetermined amount of time. Should toy 400 then be restarted (i.e., there is an actuation of switch 428) prior to the predetermined wait mode period expiration, the toy 400 will continue in the previous mode (counting or music) prior to the low velocity condition. Either a non-interruptible speech counting phrase or music segment will play on the next actuation of switch 428 from the zero velocity/stop condition contingent on the toy's previous mode at the zero velocity/stop condition. The velocity of toy 400 will again be remeasured during the playing of either the counting speech phrase or musical note segment and the next sequential numeric speech phrase or the next melody segment will play contingent on the velocity of toy 400. If the velocity of toy 400 remains at zero (i.e., there is no actuation of switch 428) after the predetermined wait mode period expiration, the toy 400 will reduce power.

A controller 430 controls the output of sounds and lights emitted from toy 400. The controller 430 includes a controller logic that is stored in a memory of the controller 430. The memory also stores the audio content that is output by the toy 400. The controller 430 is configured to produce select audio output in predetermined sequences according to the programming of the controller logic as would be apparent to those skilled in the art. Optionally, the controller 430 may be configured to produce the audio output in a random fashion. An example of a controller 430 that can be used in the present invention is the 58200 that is available from Elan Microelectrnoics Corporation. Alternative processors or controllers may be utilized provided they are capable of producing corresponding audio and visual output as intended by the present invention.

Figure 16:
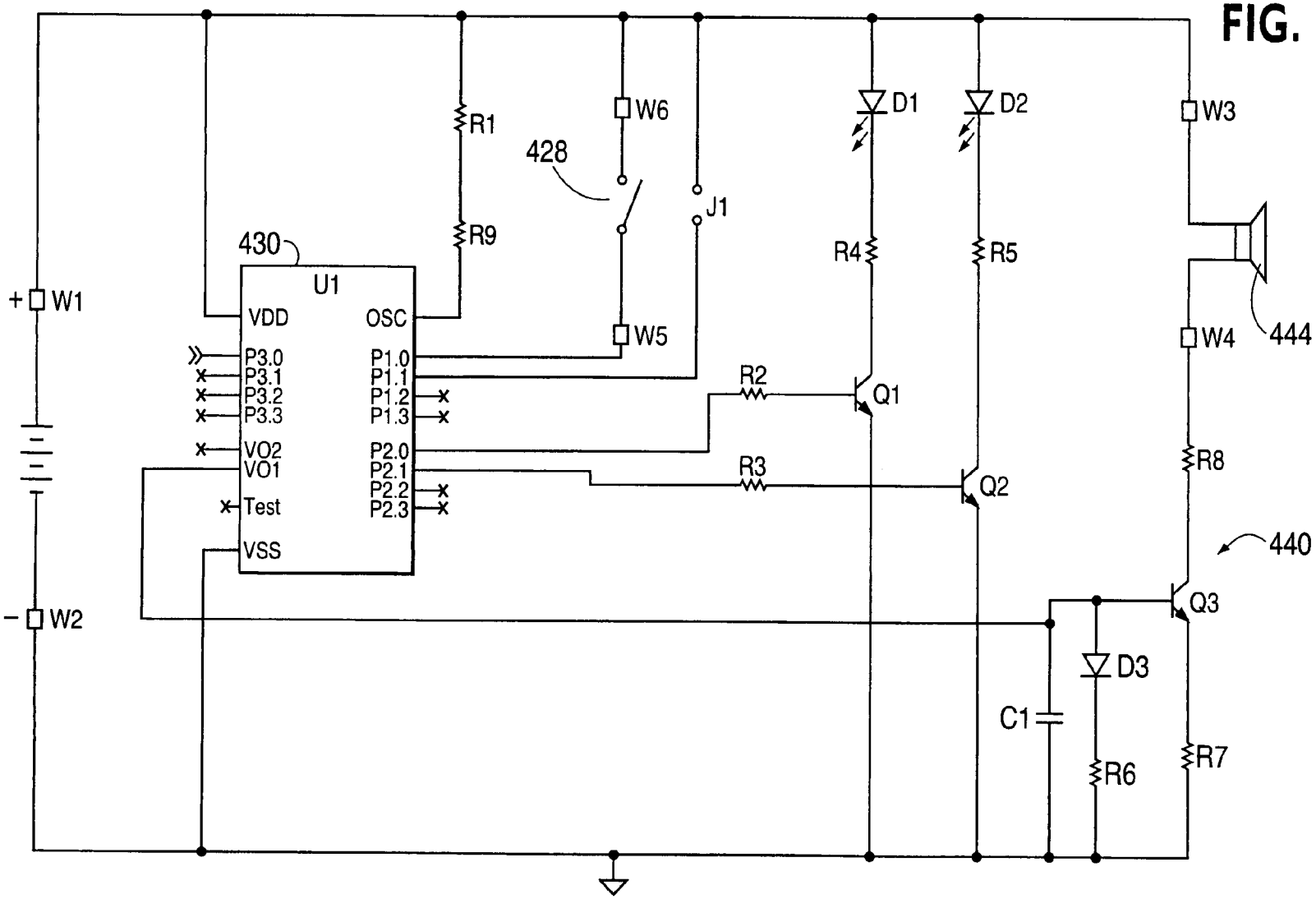
FIG. 16 is a schematic illustration of the toy illustrated in FIG. 12.

The relationships among various components of the toy 400 are schematically illustrated in FIG. 16. The controller 430 cooperates with the motion detector switch 428, and the audio system 440, and is programmed to respond to receipt of the motion signal from the motion detector switch 428. The controller 430 causes the audio system 440 to produce the audible output corresponding to the number of times the actuator 458 is triggered. Note that in this embodiment the controller 430 does not control the visual display, but rather controls only the audio output in a manner synchronized with the visual display 450 which is driven by the user.

Figure 17:
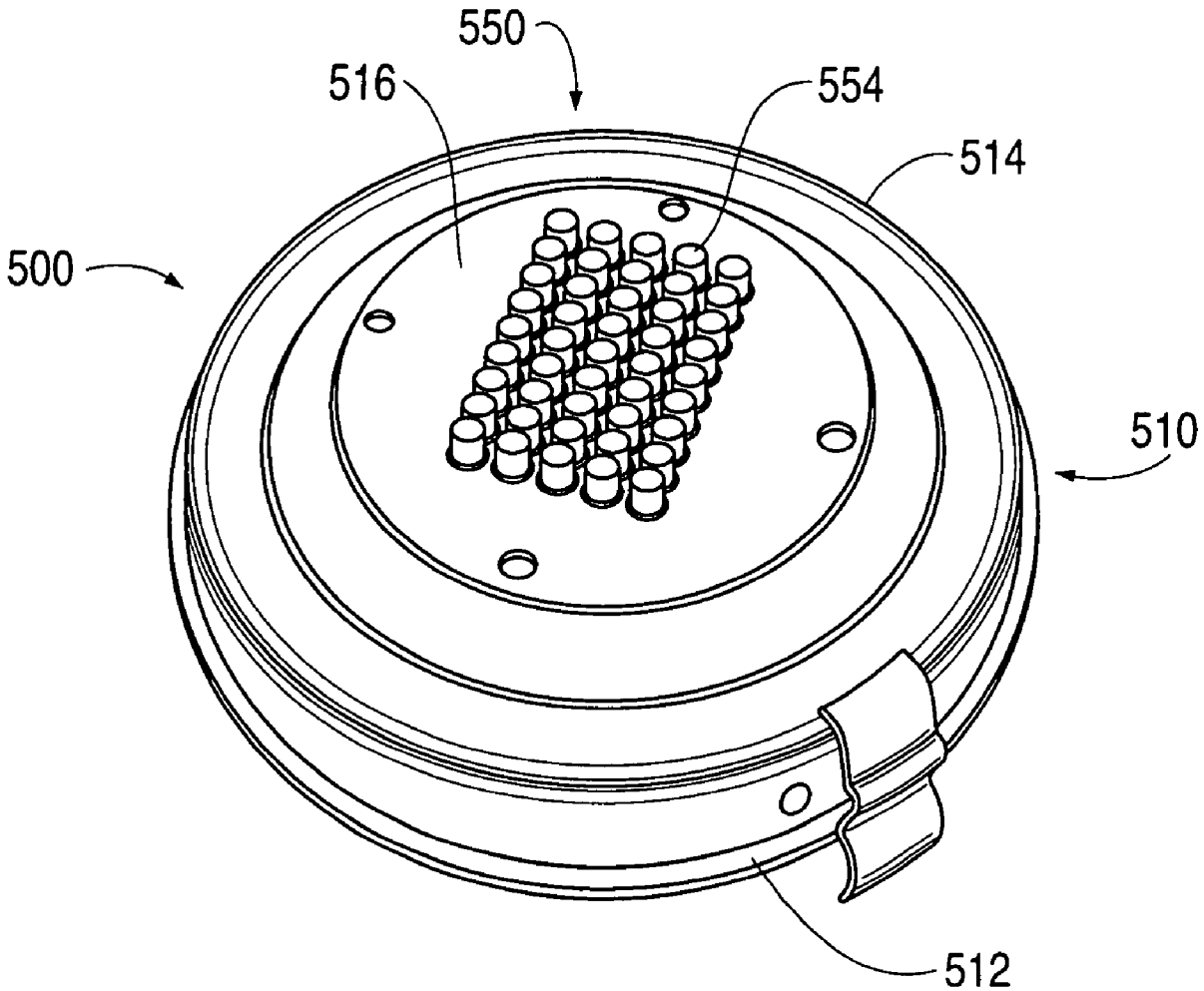
FIG. 17 is a perspective view of a fourth implementation of a toy embodying the principles of the present invention.

A fourth embodiment of the present invention, representing a fifth physical implementation of the generic embodiment described above is illustrated in FIG. 17 in which the toy 500 includes a body 510 in the shape of a ball having a first housing 512 and second housing 514 that are separated by a display surface 516. The elements and operation of this embodiment are the same as the first embodiment with the following exceptions.

A visual display 550 is coupled to the display surface 516 such that it is viewable through the transparent second housing 514. As will be appreciated, it is desirable for the body 510 to be weighted such that when it comes to a rest, the display 550 is viewable by the user of the toy 500. A motion detector 520 is located within the first housing 512 and is configured to detect motion of the body 510 relative to the support surface S. The motion detector 520 provides a signal to a controller 530 to indicate that the toy 500 is in motion.

The visual display 550 is capable of selectively producing a visual output as described above. In this embodiment, visual display 550 is implemented as an array 554 of light emitting diodes (LEDs) 558 that are selectively activated to produce images on the visual display 550. As will be appreciated, the visual display 550 for this embodiment of toy 500 may be implemented with other types of displays that are capable of producing various images such as, for example, a Liquid Crystal Display (LCD).

Figure 18:
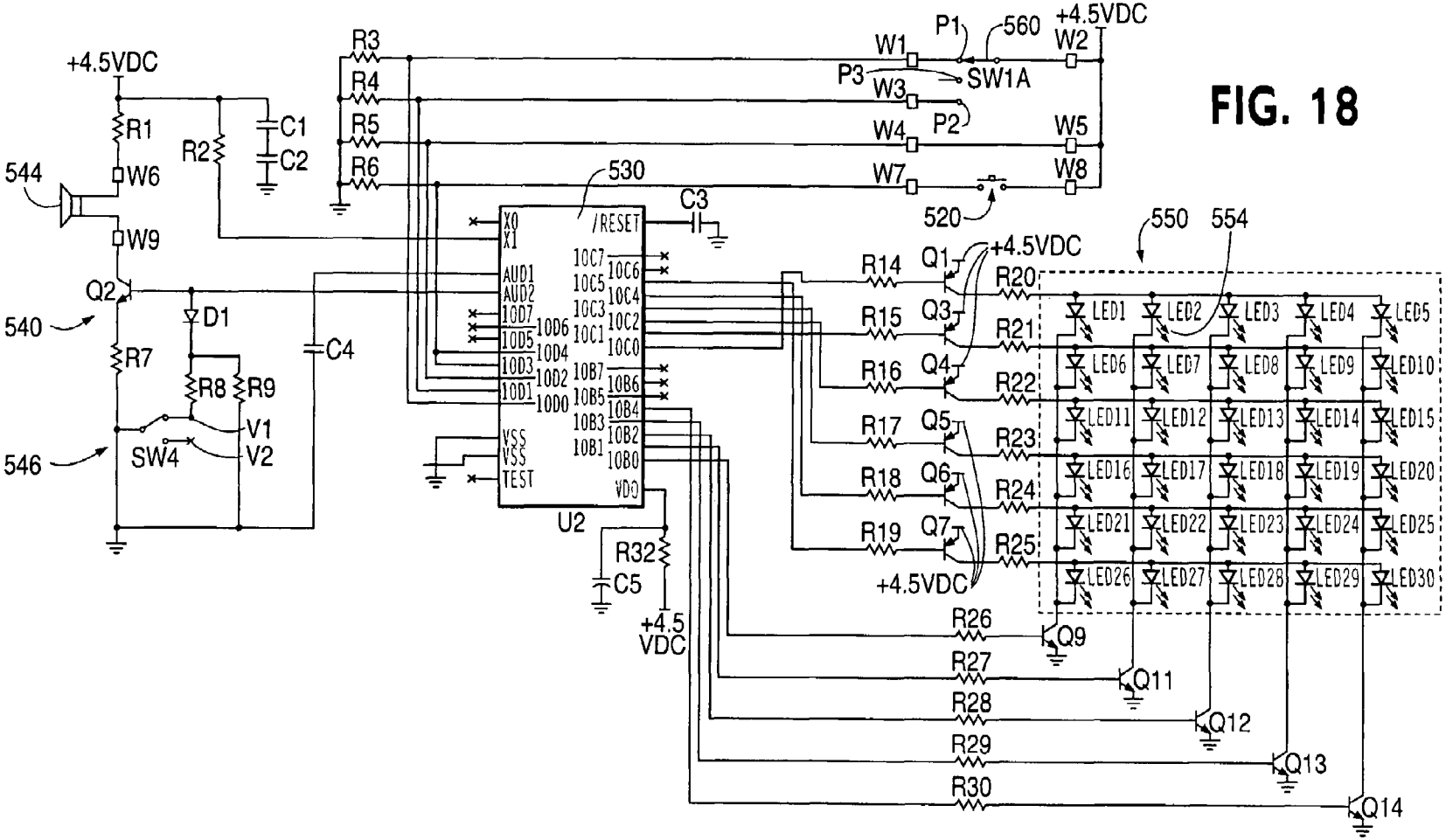
FIG. 18 is a schematic illustration of the toy illustrated in FIG. 17.

An audio system 540 is included in the toy 500 that is capable of selectively producing an audible output that corresponds to, and is descriptive of, the visual output as described above with reference to the first embodiment. Various components of the toy 500 are illustrated schematically in FIG. 18. The controller 530 controls the output of sounds and lights from toy 500 in the same manner described with respect to the first embodiment.

In one mode of operation, when the switch SW1A is in a first position P1, controller 530 causes letters of the alphabet to be displayed on the visual display 550 by illuminating particular patterns of LEDs. The letters of the alphabet may be displayed sequentially or, optionally, may be displayed randomly. As each letter is displayed on the visual display 550, the audio system 540 produces an audio output corresponding to the displayed letter, such as a spoken pronunciation of the letter. The display 550 and the audio output are activated when the body 510 comes to rest. When the body 510 comes to rest, the motion detector 520 indicates that there is no relative motion of the body 510 causing the controller 530 to activate the audio system 540 and the visual display 550. The controller 530 causes the display 550 to cycle through the entire alphabet each time the body 510 comes to rest or may only display and recite a single letter each time the body 510 comes to rest. Optionally, the toy 500 may display a letter, output a spoken pronunciation of the displayed letter and also output a spoken pronunciation of a word that begins with the displayed letter each time the body 510 comes to a rest. When the body 510 is in motion, the audio system 540 may produce a series of musical notes to entertain the child before the body 510 comes to a rest.

In an alternative mode of operation, with switch SW1A is in a second position P2, numbers may be displayed on the visual display 550 by illuminating particular patterns of LEDs. The numbers may be displayed sequentially or, optionally, may be displayed randomly. As each number is displayed on the visual display 550, the audio system 540 produces an audio output corresponding to the displayed number, such as a spoken pronunciation of the number. The display 550 and the audio output are activated when the body 510 comes to rest as described above. The controller 530 causes the display 550 to display a subsequent number each time the toy 500 comes to a rest.

In a further mode of operation, shapes may be displayed on the visual display 550 by illuminating particular patterns of LEDs. The shapes may be displayed in a predetermined pattern or may be displayed randomly. As each shape is displayed on the visual display 550, the audio system 540 produces an audio output corresponding to the displayed shape such as a spoken pronunciation of the displayed shape. The display 550 and the audio output are activated as described above.

While particular, illustrative embodiments of the invention have been described, numerous variations and modifications exist that would not depart from the scope of the invention. For example, the features of the various embodiments may be combined in the several modes of operation of the toys described. For example, a toy may have an array of LEDs such as those described in the toys 200, 500 that also include lights of various colors. Such a toy may produce a representation of a particular shape using only certain color lights. The audio system would then output a spoken pronunciation of the color as well as the shape. For example, if the visual display produced the image of a circle using blue LEDs, the corresponding audio output would be "BLUE CIRCLE." Additionally, the various displays could be combined in a single toy. In such an embodiment, the displays are alternatively selectable by switches or by different relative motions of the toy. For example, if the toy is moved forward across a support surface, a first display or mode would be activated. Likewise, if the toy is moved backward, a second display or mode would be activated. Moreover, instead of including LEDs as described above, any of the embodiments described may utilize light bulbs to produce the desired visual output.

Moreover, the display 350 of the toy 300 can illuminate LEDs in particular positions and the audio system 340 could produce a spoken pronunciation of the position of the LED (e.g., left, middle, right).

A toy having a display such as the displays 250, 550 could also provide a visual output of a word and a corresponding spoken pronunciation of the displayed word.

Instead of forming letters or numbers from arrays of lights, a graphical representation of a letter or number can be selectively illuminated, such as by a light. Thus, for example, in the third embodiment, the graphics on the handle (representing numbers from one to ten) could be selectively illuminated in synchronization with the audible output of the spoken pronunciation of the number.

The various features of the invention have been described in relation to children's educational toys. However, it will be appreciated that many of the features, such as the visual displays, the various body configurations, the audio outputs, and the motion detectors may be implemented on a variety of other children's products such as alternative toys, educational devices, infant support attachments, high chair attachments, stroller attachments, etc. Moreover, variations and modifications exist that would not depart from the scope of the invention. A number of these variations have been set forth above.

What is claimed is:

1. A toy, comprising:

a body adapted to be grasped by a user to propel the toy along a support surface;

a motion detector coupled to said body;

said motion detector configured to detect motion of said body relative to the support surface;

a visual display configured to selectively produce a visual output, the visual display including an enclosure mounted on said body;

an actuator configured to actuate in response to the motion; and an object in said enclosure configured to be agitated by said actuator; and an audio system configured to selectively produce a first audible output associated with said visual output, said first audible output being a spoken pronunciation of a number of times said object has been agitated, said motion detector configured to output a first signal associated with a first speed of said body, and a second signal associated with a second speed of said body different from said first speed, the second signal operative to cause said audio system to produce a second audible output that is a musical composition.

2. The toy of claim 1, wherein the object is one object from a plurality of objects.

3. The toy of claim 1, further comprising a roller coupled to said body for rotation with respect to said body, said roller including a first wheel and a second wheel coupled by an axle.

4. The toy of claim 3, wherein said actuator is a spring-loaded actuator configured to cyclically actuate in response to the motion of the roller.

5. The toy of claim 1, wherein the audio system outputs the spoken pronunciation in response to actuation of a switch.

6. The toy of claim 1, wherein the audio system outputs the spoken pronunciation in response to actuation of a switch, the switch configured to be contacted by an element disposed on an axle of a roller adjacent to the switch.

7. The toy of claim 1, further comprising a roller coupled to said body, the roller configured to rotate with respect to said body; and a light source coupled to said body, the light source configured to illuminate based on rotation of the roller.

* * * * *